US005720399A

United States Patent [19]

Kohlhaas

[11] Patent Number: 5,720,399

[45] Date of Patent: Feb. 24, 1998

[54] RACK AND PALLET STORAGE SYSTEM

[76] Inventor: Frank Anthony Kohlhaas, 130 Lake Julia Dr. N., Ponte Vedra Beach, Fla. 32082

[21] Appl. No.: 699,116

[22] Filed: Aug. 16, 1996

[51] Int. Cl.[6] ..... A47F 7/00

[52] U.S. Cl. ..... 211/133.1

[58] Field of Search ..... 211/133.1, 134, 211/186, 187, 189; 108/162, 180, 153, 106, 144

[56] References Cited

U.S. PATENT DOCUMENTS

| | | | |
|---|---|---|---|
| 5,011,031 | 4/1991 | Konstant | 211/191 |
| 5,012,938 | 5/1991 | King | 211/191 |
| 5,273,170 | 12/1993 | Azzopardi et al. | 211/191 X |
| 5,330,066 | 7/1994 | Carroll | 211/191 X |

*Primary Examiner*—Alvin C. Chin-Shue
*Assistant Examiner*—Sarah Purol
*Attorney, Agent, or Firm*—Thomas C. Saitta

[57] ABSTRACT

A combination rack and pallet storage system, where the pallets have a single upper deck member and depending legs, where for a pallet deck member of width $D_w$ and a rack support framework having an interior distance or opening $R_w$, the outer leg edge of each of the outermost legs is positioned from the edge of the deck member by a distance of G, where G is determined by the following calculation:

$$D_w - R_w - SF \geqq G \geqq \frac{(D_w - R_w)}{2} + CF$$

where SF is a safety factor representing the minimum required overhang distance of the deck member on the support framework, and CF is a clearance factor representing the minimum amount of clearance required between the outer leg edge of the outermost legs and the inner edge of the support framework.

3 Claims, 3 Drawing Sheets

RACK AND PALLET STORAGE SYSTEM

BACKGROUND OF THE INVENTION

This invention relates generally to the field of rack and pallet storage systems, where a raised rack system allows loaded pallets to be positioned in a vertical orientation such that multiple pallets will occupy the same total floor area as a single pallet. More particularly, the invention relates to such systems where the pallet is of the type composed of a single deck with multiple depending support legs and where the racks have at least two opposing support members spanning a relatively large open area, such that the support legs of the pallet are positioned relative to the outer edges of the support deck in a manner dependent on the combined factors of the size of the opening between the support members, a minimum clearance factor to allow the operator to properly position the pallet and a minimum safety factor which precludes the pallet from falling through the opening.

The use of pallets to receive large numbers of discrete items for easy transport and storage is well known, a pallet being defined as a deck member separated by spacers from a bottom member, or a deck member raised on a plurality of support legs. The pallets are moved by fork lifts, hand trucks or other means which have a pair of generally parallel tines which are inserted beneath the support deck of the pallet, enabling the pallet to be lifted, transported and set down at any desired location. In storage situations space is of prime importance, such that the optimum situation occurs when the most goods are stored in the smallest area. Vertically stacking items or pallets containing items obviously increases the total number of items stored in a given amount of floor area. In many storage facilities, rack systems with a number of horizontal shelves are installed, and pallets are vertically arranged by placing them onto the shelves. Maneuvering and properly positioning the pallets on the upper shelves is difficult, since the operator must lower the pallet onto the shelf in the correct spot and then lower the tines the precise distance which enables them to be withdrawn from beneath the pallet without shifting the pallet. Removing a pallet from an upper shelve is also difficult, since the tines must be precisely positioned for insertion—if too low or too high, the pallet will be pushed, possible knocking it off the far side of the shelf.

It is an object of this invention to provide for a combination rack and pallet storage system where the pallets can be stored in vertical orientation whereby the pallet is retained by the structure of the rack in a manner such that the pallet cannot accidentally fall from the rack. It is a further object to provide such a system where the pallets are of the type defined by a single deck member and plural depending legs, and where the rack is of the type having support members defining large areas with no horizontal shelving, such that the depending legs act as detent means to prevent the pallet from shifting too far relative to the support members of the rack. It is a further object to provide such a system where the legs act as stops to allow easy removal of the pallet from the fork lift tines, especially in lift-over rack systems where the rack has support members on all four sides of the pallet.

SUMMARY OF THE INVENTION

The invention comprises in combination a rack and pallet storage system, where the pallets have a single deck member for supporting discrete items and a plurality of depending legs or feet to support the deck member a short distance above the floor to enable the pallet to be raised, transported and lowered by fork lifts, hand trucks or other devices having a pair of lifting tines which are positioned underneath the deck member between the support legs. The rack provides a multi-level support framework which allows a plurality of loaded pallets to be stacked in a separated, vertical manner in order to provide more storage in the same area of floor space. The rack and pallets are cooperatingly dimensioned such that the pallets are retained by the rack in a secure manner, such that the legs of the pallet act as detents to preclude excessive lateral movement of the pallet relative to the rack. In this manner the pallet is precluded from shifting to such an extent that an edge of the deck member would no longer be supported by the rack and the pallet would fall through the rack opening. The legs of the pallet also act as guide members during the unloading and loading of the pallet onto the rack, such that it is not possible for a fork lift operator to improperly position the pallet onto the rack. The rack may be of the drive-through type, wherein the front of the rack or the front and rear is unrestricted, having no support framework for the front and rear edges of the pallet, such that the pallet is placed onto lateral supports only and the lift truck is able to pass between the lateral supports, or the rack may be of the lift-over type, wherein the rack has supports on all four sides and the pallet must be first raised above the level of the supports, moved forward by the lift truck in position over the supports and then lowered onto the support framework.

To insure that the pallets are securely and safely retained on the racks, regardless of the type of rack employed, the deck dimensions, distance of the legs from the deck edges and the interior distance between the support framework of the rack must be interrelated in precise manner. For a pallet deck member of width $D_w$ and a rack support framework having an interior distance or opening $R_w$, the outer leg edge of each of the outermost legs must be positioned from the edge of the deck member by a distance G, where G is determined by the following calculation:

$$D_w - R_w - SF \geqq G \geqq \frac{(D_w - R_w)}{2} + CF$$

where SF is a safety factor representing the minimum required overhang distance of the deck member on the support framework, and CF is a clearance factor representing the minimum amount of clearance required between the outer leg edge of the outermost legs and the inner edge of the support framework. For a lift-over rack, a different calculation is required since it is the front-to-back dimension which may be most important, as there may be no lateral support members utilized. For a pallet deck member of front-to-back length $D_l$ and a rack support framework having an interior lengthwise distance or opening $R_l$, the outer edge of each of the outermost legs must be positioned from the edge of the deck member by a distance G, where G is determined by the following calculation:

$$D_l - R_l - SF \geqq G \geqq \frac{(D_l - R_l)}{2} + CF$$

where SF is a safety factor representing the minimum required overhang distance of the deck member on the support framework, and CF is a clearance factor representing the toal minimum amount of clearance required between the outer edge of the outermost legs and the inner edge of the support framework.

DETAILED DESCRIPTION OF THE INVENTION

Figure 1:
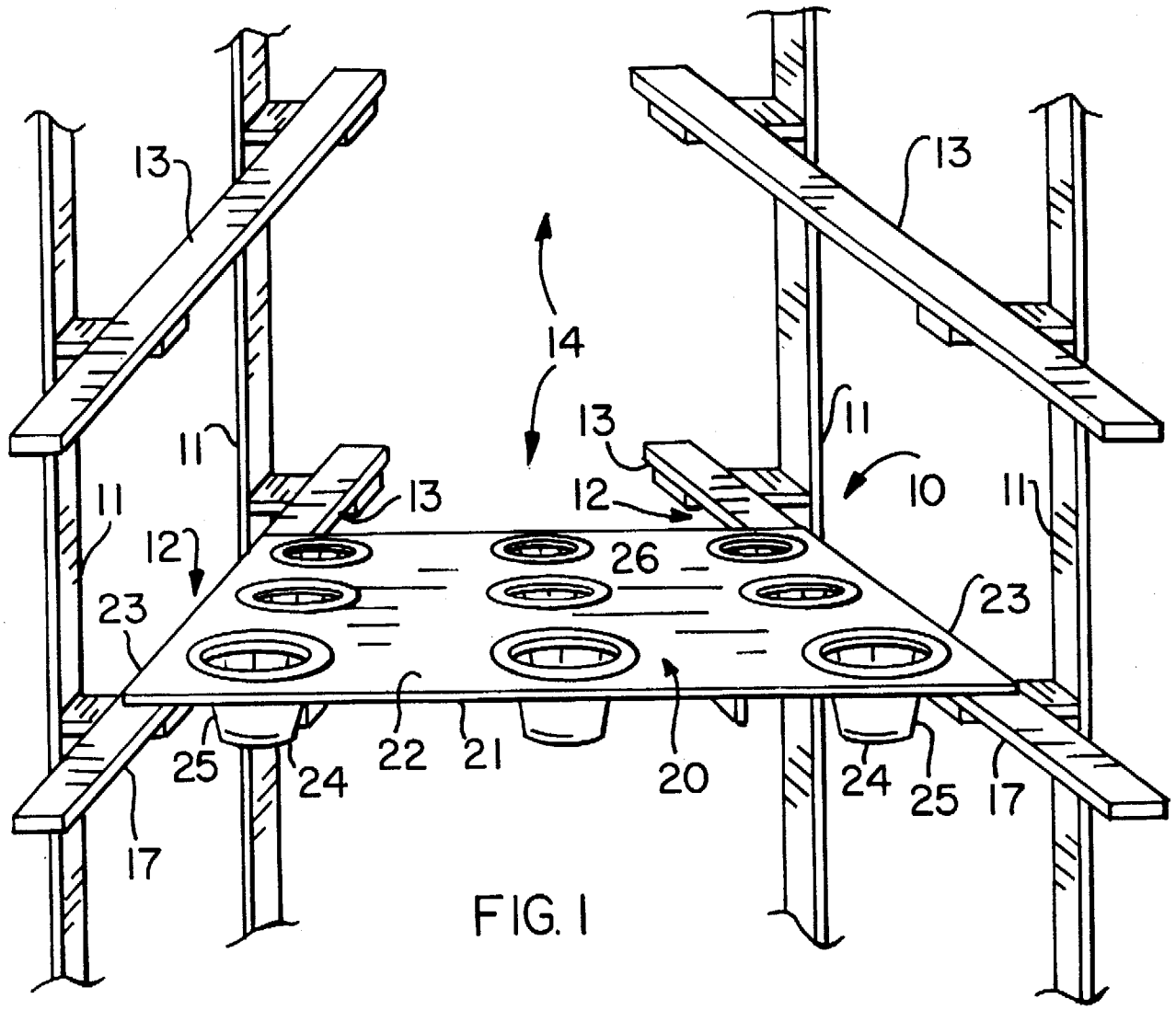
FIG. 1 is a perspective view showing a multi-level, drive-through rack and pallet storage system.

With reference now to the drawings, the invention will be described in detail with regard to the best mode and preferred embodiment. The invention comprises in general a combination rack and pallet storage system, the rack 10 being a structural support framework enabling one or more pallets 20 to be supported a distance above the floor, the pallets 20 having a single upper deck member 21 and a plural number of depending legs 24 to raise the deck member 21 off the floor to allow for insertion of lift tines to reposition the pallet 20, the pallets 20 being configured such that the legs 24 are positioned relative to the edges 23 of the deck member 21 a proper distance to prevent lateral movement of the pallet 20 on the rack 10 beyond the point where an edge 23 of the deck member 21 would no longer be supported by the rack 10.

A pallet 20 of the system comprises a generally planar upper deck member 21 having a generally rectangular upper surface 22 onto which may be stacked a number of discrete items, such as boxes, cans, etc. The deck member 21 is bounded on each of four sides by a first and second set of opposing edges 23. The pallet 20 does not have a lower or bottom planar deck member mounted parallel to the upper deck member 21. Beneath the deck member 21 and attached thereto are a plural number of peripheral support legs 24. There may also be a number of interior or inner support legs 26. The support legs 24, and inner support legs 26 if present, act to maintain the deck member 21 a relatively short distance above the floor or other surface onto which the pallet 20 is placed. The support legs 24 and 26 may be of any shape in cross-section, such as circular, square, rectangular, hexagonal, etc., and may be straight or tapered. Each peripheral support leg 24 has an outer leg edge 25, defined as the point or segment on the leg 24 closest to the nearest edge 23 of the deck member 21. A peripheral leg 24 mounted near a corner of the deck member 21 may have two points or segments delineated as outer leg edges 25, one outer leg edge 25 being closest to one edge 23 making up one half of the corner of the deck member 21 and the other outer leg edge 25 being closest to the adjoining edge 23 which forms the other half of the corner.

Figure 2:
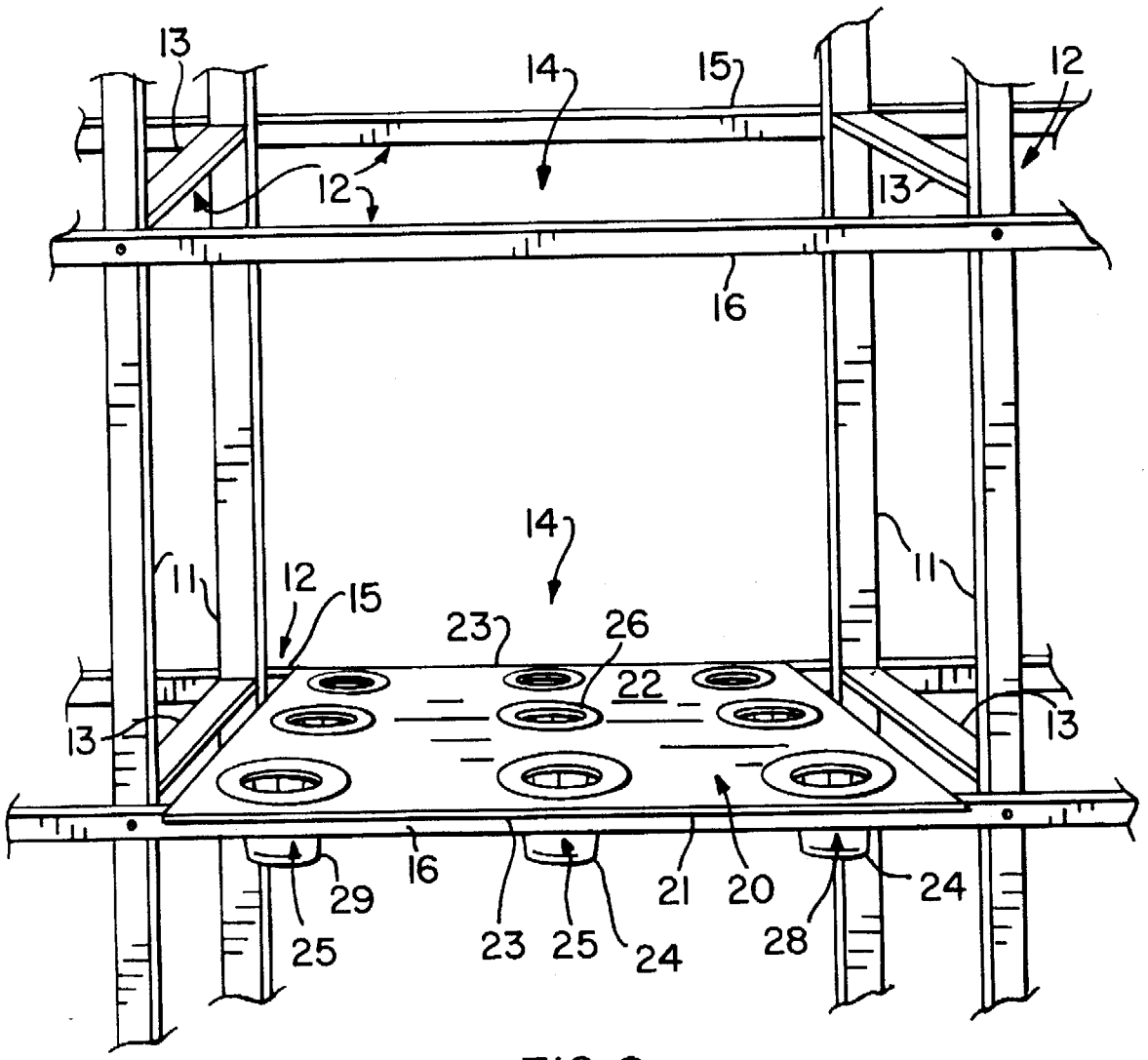
FIG. 2 is a perspective view showing a multi-level, lift-over rack and pallet storage system.

The rack 10, made of steel tubing or the like, is the means to support one or more pallets 20 in loaded condition in vertical orientation, such that two or more pallets 20 will occupy the same floor space area occupied by a single pallet 20. The rack 10 comprises a number of vertical members 11 joined by at least one set of opposing generally horizontal pallet support members 12, the combination of support members 12 defining an opening 14. In one embodiment, as shown in FIG. 1, the set of opposing pallet support members 12 are two lateral support members 13 positioned between vertical members 11. This type of rack 10 is commonly known as a drive-through type rack, as there are no support members 12 positioned between the vertical members 11 at the front or the rear of the rack 10. An alternative embodiment for the rack 10 is shown in FIG. 2, where there is a second set of opposing pallet support members 12 consisting of a front support member 16 and a back support member 15, each attached to vertical members 11 to form a rectilinear support framework in combination with the first set of opposing support members 12. This type of rack 10 is commonly known as a lift-over rack, and the pallet 20 is supported by the front and back support members 16 and 15 alone or in combination with the lateral support members 13. Each of the support members 12 consisting of the lateral support members 13, the back support member 15 or the front support member 16 have an inner edge 17 defining the opening 14.

Figure 3:
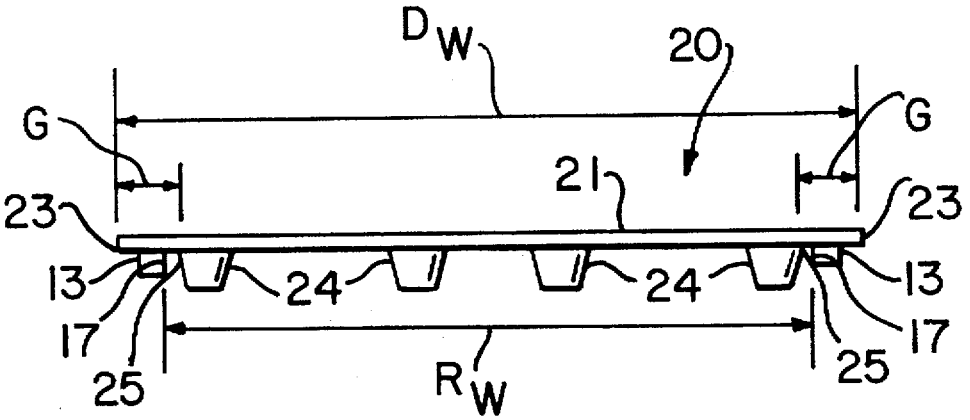
FIG. 3 is a representational side view showing the calculation factors.

The positioning of the peripheral support legs 24, and in particular the outer leg edge 25 of each leg 24, relative to the edge 23 of the deck member 21 is critical to insure that movement of the pallet 20 relative to the support members 12 is restricted to the point that one or more of the edges 23 of pallet 20 cannot fall into the opening 14 between the support members 12. As shown in FIG. 3, the distance G, which is defined to be the distance from the outer leg edge 25 of a peripheral leg 24 to the edge 23 of the deck member 21, is a function of the width $D_w$ of the deck member 21 and the dimension $P_,$ of opening 14, which is the distance between inner edges 17 of opposing support members 12. Distance G is determined by the following calculation:

$$D_w - R_w - SF \geqq G \geqq \frac{(D_w - R_w)}{2} + CF$$

where SF is a safety factor representing the minimum required overhang distance of the deck member 21 on the lateral support members 13 of support framework member 12, and CF is a clearance factor representing the total minimum amount of clearance required between the outer leg edge 25 of the peripheral support legs 24 and the inner edges 17 of the lateral support members 13 of support framework member 12. In application, SF is the minimum amount of deck member 21 necessary to support the pallet 20 on the support members 12 without undue flexing or failure, as measured from edge 23. A typical suitable value for SF is one half inch or greater. CF is a spacing which allows some room for the operator to maneuver the pallet 20 onto the support members 12, since a precise or snug abutting of the outer leg edges 25 of support legs 24 against the inner edges 17 of support members 12 could make insertion and removal of the pallets 20 difficult. A typical suitable value for CF is one half inch or greater.

Figure 4:
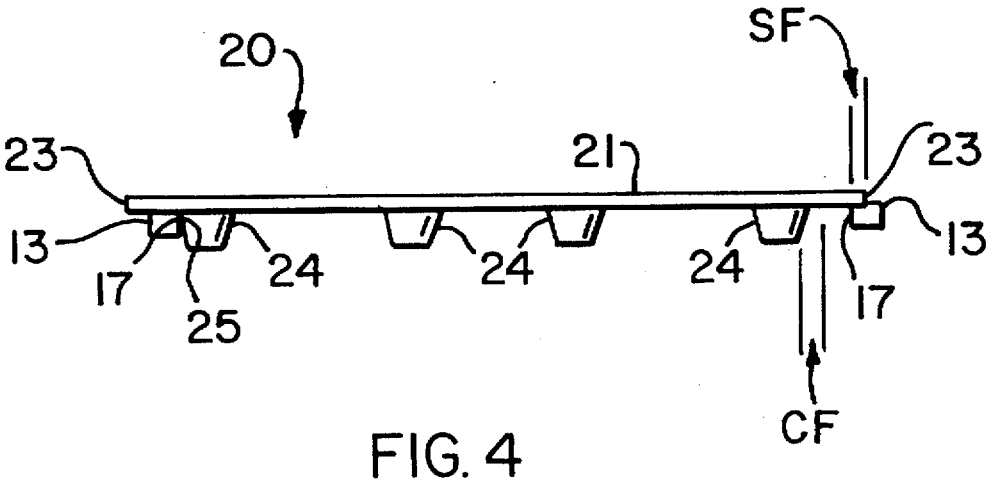
FIG. 4 is a side view showing similar to FIG. 3 showing a pallet shifted the maximum distance to one side.

The combination of rack 10 and pallet 20 as defined operates to secure the pallet 20 onto the support members 12 as shown in FIG. 4. If the pallet 20 is shifted too far in a given direction relative to the support members 12, here shown as lateral support members 13, the outer leg edge 25 of the peripheral support leg 24 will contact the inner edge 17 of a lateral support member 13 and act as a detent to restrict the deck member 21 from any further movement in that direction. Because the distance G from outer leg edge 25 to edge 23 of deck member 21 has been calculated utilizing the safety factor SF, and the legs 24 have been positioned accordingly, a portion of the deck member 23 on the opposite side to the side where the leg member 24 is abutting the lateral support member 13 equal to or greater than the SF distance will always remain supported by the opposite lateral support member 13. This prevents this edge 23 of deck member 21 from falling into opening 14 between support members 12.

In the case of a lift-over type rack 10, where the support members 12 for pallet 20 may consist of a second set of opposing generally horizontal pallet support members consisting of back support member 15 and front support member 16 mounted between vertical members 11, or the combination of lateral support members 13, back support member 15 and front support member 16, the most important dimensions may be the length or front-to-back dimensions $D_l$ of the deck member 21 and the length or front-to-back dimensions $R_l$ of the opening 14 between the inner edges 17 of the front and back support members 16 and 15. In this case, the placement of the outer leg edges 25 of peripheral legs 24 relative to the edges 23 of deck member 21 is dependent on the following calculation for G:

$$D_1 - R_1 - SF \geqq G \geqq \frac{(D_1 - R_1)}{2} + CF$$

where SF is the safety factor representing the minimum required overhang distance of the deck member 21 on the front or back support members, and CF is the clearance factor representing the total minimum amount of clearance required between the outer leg edges 25 of the outermost legs 24 and the inner edges 17 of the front and back support members. Where the pallet 20 is supported by both lateral support members 13 and front and back support members 16 and 15, then separate calculations must be done for both dimensions, unless the opening 14 and deck member 21 are square, in which case the G values will be the same in both directions.

For example, in a combination rack and pallet storage system where the rack 10 has only lateral support members 13 connected to vertical members 11 and forming an opening 14 with $R_w$, equal to 35 inches, where the deck member 21 width $D_w$ is equal to 40 inches, and where SF and CF are chosen to be ½ inch, the distance G between each outer leg edge 25 and the edge 23 of the deck member 21 must be between 4.5 inches and 3 inches, inclusive. This will insure that even if the maximum value of G is used, i.e., the legs 24 are positioned relatively far from edges 23 of deck member 21, and the pallet 20 is shifted laterally its full extent such that the outer leg edge 25 on one side abuts the inner edge 17 of one of the lateral support members 13, there will be a minimum overhang of ½ inch of deck member 21 on top of the opposite side lateral support member 13. Correspondingly, if the minimum value of G is used, i.e., the legs 24 are positioned relatively close to edges 23 of deck member 21, there will still be adequate clearance between the leg edges 25 and the inner edges 17 of lateral support members 13 for easy placement and removal of the pallet 20 on the rack 10. Calculations for G using $R_l$ and $D_l$ for front-to-back dimensions are similar in effect.

It is contemplated that substitutions and equivalents may be apparent to those skilled in the art, so the true scope and definition of the invention is to be as set forth in the claims below.

I claim:

1. A combination rack and pallet system comprising a rack having vertical members maintaining in elevated position a set of opposing pallet support members, each of said pallet support members of said set of opposing pallet support members having an inner edge defining an opening having an interior distance $R_w$, and a pallet having a generally planar deck member with opposing deck edges defining a width $D_w$ and a plurality of peripheral support legs depending from said deck member relatively adjacent to one of said opposing deck edges, each of said support legs having an outer leg edge, where the distance G between said outer leg edge of each of said peripheral support legs and the closest of said opposing deck edges is defined by $$D_w - R_w - SF \geqq G \geqq \frac{(D_w - R_w)}{2} + CF$$

where SF is a safety factor defined as the minimum required overhang distance of each of said opposing deck edges on each of said opposing pallet support members, and CF is a clearance factor defined as the total minimum amount of clearance required between said outer leg edges of said peripheral support legs and the closest said inner edges of said opposing pallet support members.

2. The system of claim 1, further comprising a second set of opposing pallet support members connected to said set of opposing pallet support members to form a rectilinear support framework for said pallet, each of said pallet support members of said second set of opposing pallet support members having an inner edge defining an opening having an interior distance $R_l$, said pallet having a second set of opposing deck edges defining a width $D_l$ and a plurality of peripheral support legs depending from said deck member relatively adjacent to one of said second set of opposing deck edges, each of said support legs having an outer leg edge, where the distance G between said outer leg edge of each of said peripheral support legs and the closest of said second set of opposing deck edges is defined by $$D_1 - R_1 - SF \geqq G \geqq \frac{(D_1 - R_1)}{2} + CF$$

where SF is a safety factor defined as the minimum required overhang distance of each of said second set of opposing deck edges on each of said second set of opposing pallet support members, and CF is a clearance factor defined as the total minimum amount of clearance required between said outer leg edges of said peripheral support legs and the closest said inner edges of said second set of opposing pallet support members.

3. A combination rack and pallet system comprising a rack having vertical members maintaining in elevated position a set of opposing lateral support members, a back support member and front support member connected to said set of opposing lateral support members to form a rectilinear support framework for a pallet, each of said back support member and said front support member having an inner edge defining an opening having an interior distance $R_l$, and a pallet having a generally planar deck member with opposing deck edges defining a width $D_l$ and a plurality of peripheral support legs depending from said deck member relatively adjacent to one of said opposing deck edges, each of said support legs having an outer leg edge, where the distance G between said outer leg edge of each of said peripheral support legs and the closest of said opposing deck edges is defined by $$D_1 - R_1 - SF \geqq G \geqq \frac{(D_1 - R_1)}{2} + CF$$

where SF is a safety factor defined as the minimum required overhang distance of each of said opposing deck edges on each of said front and back support members, and CF is a clearance factor defined as the total minimum amount of clearance required between said outer leg edges of said peripheral support legs and the closest said inner edges of said front and back support members.

* * * * *